US011452380B2

(12) United States Patent
Oomen et al.

(10) Patent No.: US 11,452,380 B2
(45) Date of Patent: Sep. 27, 2022

(54) SEAT COMPRISING SUSPENSION FABRIC WITH COMPRESSION LIMITERS

(71) Applicant: Illinois Tool Works Inc., Glenview, IL (US)

(72) Inventors: Craig Martin Oomen, Lowell, MI (US); Randy James Sayers, Howard City, MI (US); Samuel Smith, Allendale, MI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/284,093

(22) PCT Filed: Oct. 14, 2019

(86) PCT No.: PCT/US2019/056081
§ 371 (c)(1),
(2) Date: Apr. 9, 2021

(87) PCT Pub. No.: WO2020/086314
PCT Pub. Date: Apr. 30, 2020

(65) Prior Publication Data

US 2021/0353067 A1 Nov. 18, 2021

Related U.S. Application Data

(60) Provisional application No. 62/750,570, filed on Oct. 25, 2018.

(51) Int. Cl.

| | |
|---|---|
| ***A47C 7/28*** | (2006.01) |
| ***A47C 7/18*** | (2006.01) |
| ***A47C 31/02*** | (2006.01) |

(52) U.S. Cl.
CPC ..... *A47C 7/282* (2013.01); *A47C 7/18* (2013.01); *A47C 31/023* (2013.01)

(58) Field of Classification Search
CPC ..... A47C 7/282; A47C 7/18; A47C 31/023; B68G 7/00; B68G 13/00
USPC ..... 297/452.56
See application file for complete search history.

(56) References Cited

U.S. PATENT DOCUMENTS 3,616,142 A * 10/1971 Schrotenboer ..... A47C 7/34 442/35
4,502,731 A * 3/1985 Snider ..... A47C 7/282 297/452.15 X
4,713,854 A * 12/1987 Graebe ..... A47C 27/144 5/652

(Continued)

OTHER PUBLICATIONS

International Search Report and Written Opinion of the International Searching Authority from corresponding PCT Application No. PCT/US2019/056081, dated Jan. 24, 2020 (14 pages).

*Primary Examiner* — Rodney B White
(74) *Attorney, Agent, or Firm* — Quarles & Brady LLP

(57) ABSTRACT

A suspended fabric seat includes a frame, a woven fabric suspended in the frame and a plurality of compression limiters attached to the woven fabric. The woven fabric is formed from monofilament fibers that are oriented in a first direction and textile fibers oriented in a second direction transverse to the first direction. The plurality of compression limiters are oriented in the first direction and are formed from a material compatible with the woven fabric. A method for making the suspended fabric seat is also disclosed.

20 Claims, 7 Drawing Sheets

(56) References Cited

U.S. PATENT DOCUMENTS 5,393,596 A 2/1995 Tornero et al.
5,765,804 A * 6/1998 Stumpf ..... A47C 1/03238 248/404
5,975,634 A * 11/1999 Knoblock ..... A47C 7/46 297/452.15 X
6,378,944 B1 * 4/2002 Weisser ..... A47C 7/40 297/218.5 X
6,540,950 B1 * 4/2003 Coffield ..... B29C 45/14336 297/452.64
6,899,398 B2 * 5/2005 Coffield ..... B29C 45/14336 297/452.56
7,066,537 B2 * 6/2006 Coffield ..... A47C 31/023 297/284.7
8,329,281 B2 12/2012 Coffield
8,857,033 B2 10/2014 Coffield et al.
9,156,211 B2 10/2015 Coffield
10,159,351 B1 * 12/2018 Alexander ..... A47C 7/32
10,435,822 B2 * 10/2019 Buffington ..... D02G 3/32
10,874,220 B2 * 12/2020 Aldrich ..... B29C 70/56
2002/0043843 A1 * 4/2002 Pennington ..... A47C 7/004 297/301.1
2002/0106479 A1 * 8/2002 Coffield ..... A47C 31/023 428/99
2003/0001424 A1 * 1/2003 Mundell ..... A47C 7/282 297/452.56
2003/0042783 A1 * 3/2003 Potes ..... A47C 31/023 297/452.56
2004/0012240 A1 * 1/2004 Hall, Jr. ..... A47C 31/02 297/452.56 X
2006/0024474 A1 * 2/2006 Coffield ..... A47C 31/02 428/192
2006/0181126 A1 * 8/2006 Eysing ..... A47C 7/46 297/284.1
2009/0140568 A1 6/2009 Chan et al.
2013/0088065 A1 * 4/2013 Narita ..... D03D 15/56 297/452.18 X
2015/0173514 A1 * 6/2015 Kikuchi ..... A47C 7/282 297/451.9
2020/0039399 A1 * 2/2020 Oomen ..... B60N 2/5891
2022/0039554 A1 * 2/2022 Oomen ..... B29C 33/00

* cited by examiner

SEAT COMPRISING SUSPENSION FABRIC WITH COMPRESSION LIMITERS

CROSS-REFERENCE TO RELATED APPLICATIONS

The present application represents the United States National Stage of International Application No. PCT/US2019/056081, filed Oct. 14, 2019, which claims priority to U.S. Provisional Patent Application No. 62/750,570, filed Oct. 25, 2018, both of which are incorporated by reference in their entirety.

BACKGROUND

The present invention relates to suspension fabric seating and more particularly, to suspension fabric seating that includes compression limiters.

Comfort in seating is often provide in one of two ways. First, seating shape with little compliance can be comfortable, such as hard backed chairs that are designed to mimic a typical user's body shape. Second, seating can be designed with little to no engineered shape, but with very good compliance, such as foam padded seating.

Suspension or suspended fabrics have come into common use as an alternative to hard surfaces and foam padded surfaces for seating. Such engineered suspension fabric seating surfaces can provide the comfort of foam padded surfaces in a weight similar to hard plastic seating and at relatively low cost. Advantageously, suspension fabric seating provides enhanced comfort using a preset tension in the suspension fabric that is adjustable for reaction forces to meet comfort goals, provides tension zonally across the seating surface, and is housed in a curved frame for styling character and comfort profiling in reclining kinematics.

Suspension seating fabric can be formed from monofilament fibers that are oriented across the seating surface, i.e., side-to-side as illustrated by the arrow at 1 in FIG. 2, and fill fibers, typically textile fibers, that are oriented 90 degrees relative to the monofilament fibers, or top-to-bottom (or up and down) along the seating surface as illustrated by the arrow at 2 in FIG. 2. Fabric suspension chairs can have limitations in compression because the fabric surface is in 100% tension as it relates to engineering stress. When engineering materials are placed in tension, the shape naturally tends to form a straight line, as is the case with fabric suspension seating.

The fill fibers are also stretched and in tension in end use on the chair. The textile fill fibers compete with the monofilament fibers in a tug-of-war to control the final fabric surface shape. The seating surface 3 is supported in a suspension frame that is located at the outside perimeter and resists the fabric's tension stresses, but secondarily controls the seating surface shape of the monofilament straight lines until the fill direction distorts the monofilament straight lines, as illustrated by the arrow at 4 in FIG. 2.

The monofilament fibers may be engineered to offer 5-20% elongation when loaded by the chair occupant. The relatively high elongation and reaction forces create a seating surface that is made comfortable by managing the occupant pressure map. The pressure map is a study conducted during early seat development and is based on standard mannequins (AM50, AF05, etc.) weight and shape while using a seat shape desired by seating designers and stylists. The fill fibers may have relatively low elongation 1-8% and may be tensioned to move the monofilaments in what would ordinarily be a straight line (FIG. 2.) However, since all of the fibers in suspension fabric chairs are in tension, final chair shapes are limited.

The shape of the suspension fabric seating may also be limited in those areas where the fabric folds to form the edges or creases, for example, between the chair back and seat bottom as indicated at 5 in FIG. 2. Inside folds are needed for chair function and construction, but such folds may cause bunching or fabric puckering at the folds. FIG. 4A shows the frame length of line 25 vs the suspension fabric center length of line 50 of a suspension fabric chair. The inside radii fold 5 where the seat back and bottom meet presents the most sever fabric bunching and/or change in length of line.

Suspension fabric chairs are also made using multi-layered fabrics. The additional layers can include, for example, leather, vinyl, or polyester upholstery. The additional layers add thickness to the suspension fabric that also creates a physical length of line when inside folds are formed in the final chair construction. The inside folds may pucker in production because all of the layers of the seating surface are in engineering tension. Puckering detracts from the aesthetics of the seating and can also adversely impact occupant comfort.

Another issue that has been observed with suspension seating is in the areas near the suspension frame. The frames are formed from rigid materials, such as glass filled nylon, and the suspension fabric does not offer a soft touch feel in areas near the frame. The addition of foam directly over the frame is one approach to aid comfort concerns, however, foam can abrade and wear, decreasing comfort and the overall appearance of the seat. Moreover the use of foam adds limits to the design freedom of seat stylists.

Accordingly, there is a need for an improved suspension fabric. Such a fabric is used in seating applications to provide the comfort of heavier and bulky foam padded seats with a relatively light-weight and smaller profile. Advantageously, comfort is provided using a preset tension in the suspension fabric that is adjustable for reaction forces and can provide tension zonally across the seating surface. A seat having a suspended fabric can be secured to a curved frame for enhanced styling characteristics and comfort profiling in reclining kinematics.

SUMMARY

A suspended fabric seat includes a frame, a woven fabric suspended in the frame and a plurality of compression limiters attached to the woven fabric. The woven fabric can be formed from monofilament fibers that are oriented in a first direction and textile fibers oriented in a second direction transverse to the first direction. In embodiments, the plurality of compression limiters are oriented in the first direction. The compression limiters are formed from a material compatible with one or both of the monofilament and textile fibers, such as a foam material.

Such a seat provides comfort using a preset tension in the suspension fabric. The tension can be adjusted for reaction forces and can be tensioned zonally across the seating surface. The suspended fabric can be secured to a frame, such as a curved frame, for enhanced styling and profiling for reclining kinematics.

The compression limiters function as a tensile/compression member similar to bending members, rather than the fabric being a fully tensioned member.

The compression limiters are mounted on a surface of the fabric opposite an occupant side of the fabric. The compression limiters are bonded to the fabric to conform with the fabric when the fabric is distorted. In an embodiment, the woven fabric forms a seat bottom.

A carrier can be positioned on a periphery of the woven fabric, and the carrier secured in the frame. The carrier can be overmolded onto the woven fabric.

The seat can include flexible leg member extending from an edge of the frame opposite the woven fabric. A resilient member can extend from the woven fabric along the flexible leg member. One suitable resilient member is a foam member. The woven fabric can extend over the foam member to provide a consistent aesthetic for the seat.

The suspended fabric is formed with a curve in the direction of the monofilament fibers, without hindering suspension hammocking or the indentation force deflection (IFD) needed for comfort targets.

A method of making a suspended fabric seat includes positioning a woven fabric in a frame and securing a plurality of compression limiters to the woven fabric. The plurality of compression limiters can be bonded to the woven fabric. The method can include positioning the woven fabric in a carrier and securing the carrier to the frame. The carrier can be overmolded onto the woven fabric. In methods, wherein the woven fabric is formed from monofilament fibers that are oriented in a first direction and textile fibers oriented in a second direction transverse to the first direction and the compression limiters are mounted to the fabric, as by bonding the compression members to the fabric in the first direction.

These and other features and advantages of the present device will be apparent from the following description, taken in conjunction with the accompanying sheets of drawings, and in conjunction with the appended claims.

BRIEF DESCRIPTION OF THE DRAWINGS

The benefits and advantages of the present embodiments will become more readily apparent to those of ordinary skill in the relevant art after reviewing the following detailed description and accompanying drawings, wherein.

DETAILED DESCRIPTION

Figure 1:
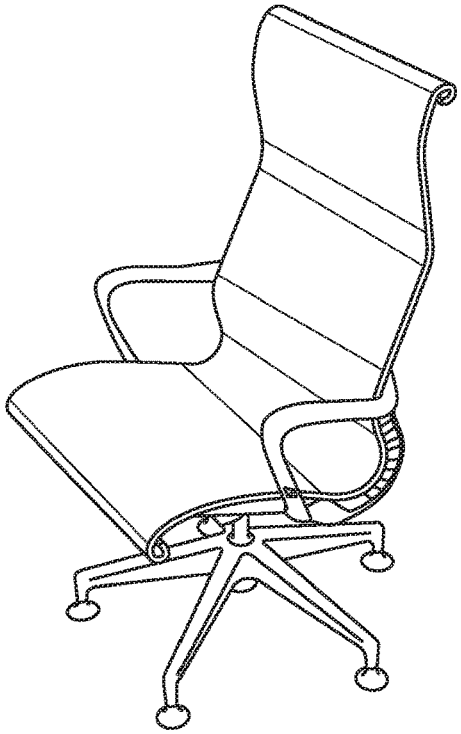
FIG. 1 PRIOR ART
FIG. 1 illustrates a prior art suspension fabric chair.
Figure 2:
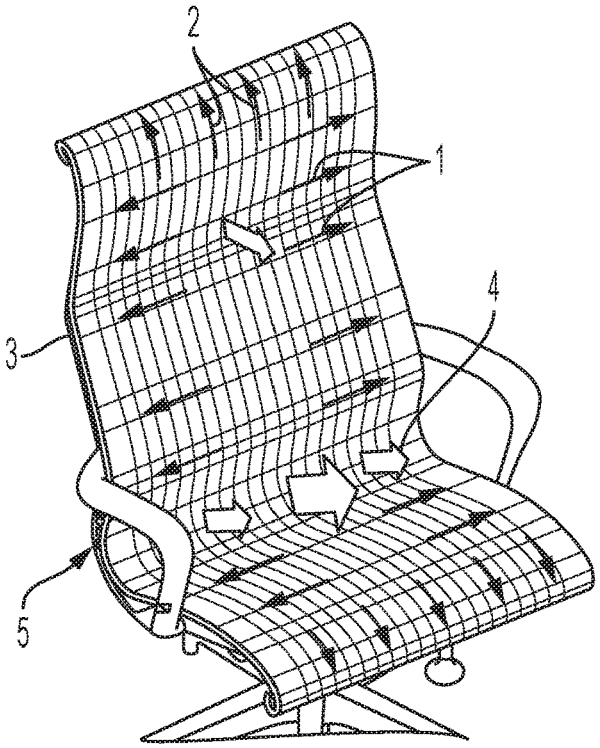
FIG. 2 PRIOR ART
FIG. 2 illustrates tension forces on a suspension fabric of the prior art suspension fabric chair of FIG. 1.
Figure 3:
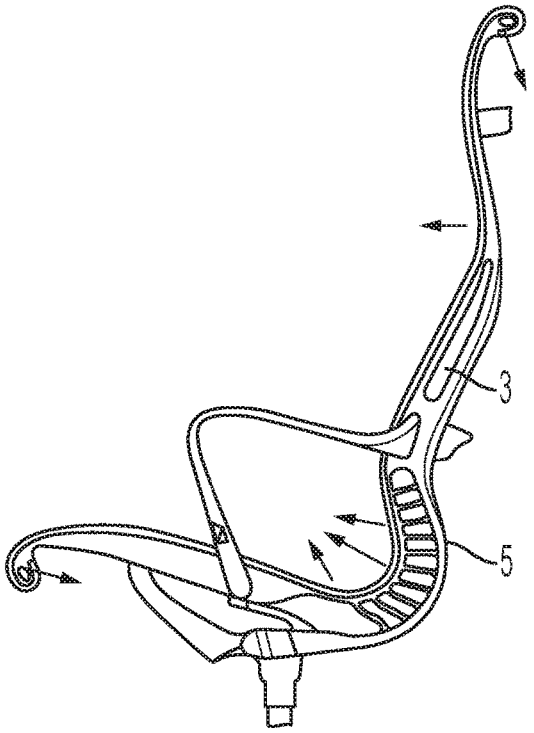
FIG. 3 PRIOR ART
FIG. 3 illustrates the natural pull direction of the suspension fabric of the prior art suspension fabric chair of FIG. 1.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 6:
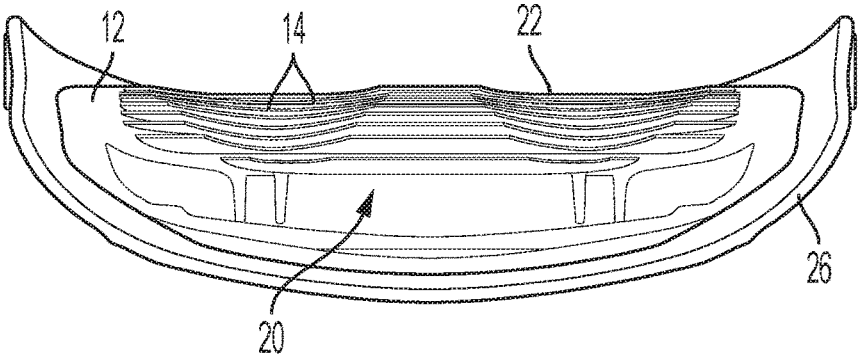
FIG. 6 illustrates a suspension fabric seating according to an embodiment of the present disclosure.
Figure 7:
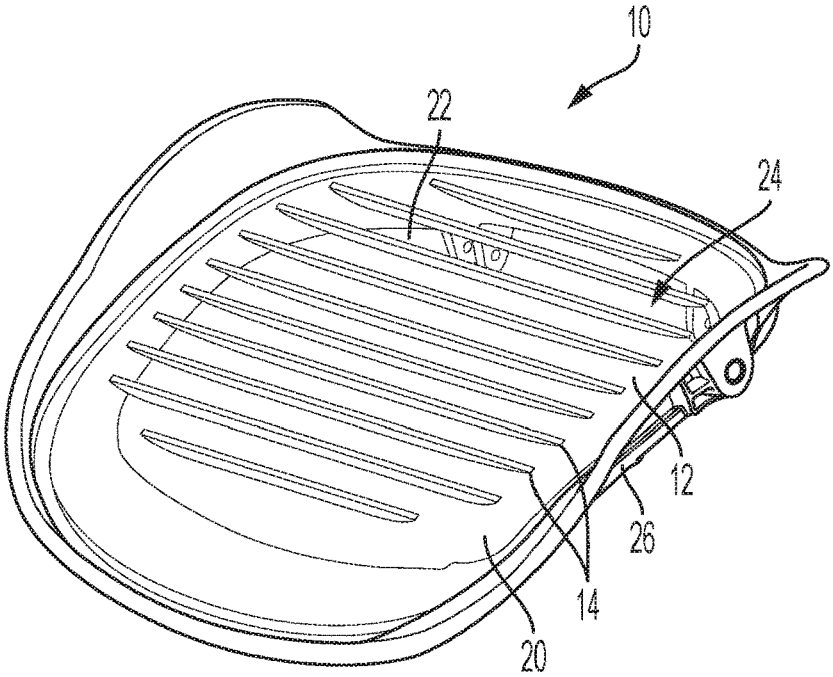
FIG. 7 is a perspective top view of the suspension fabric seating of FIG. 6.
Figure 8:
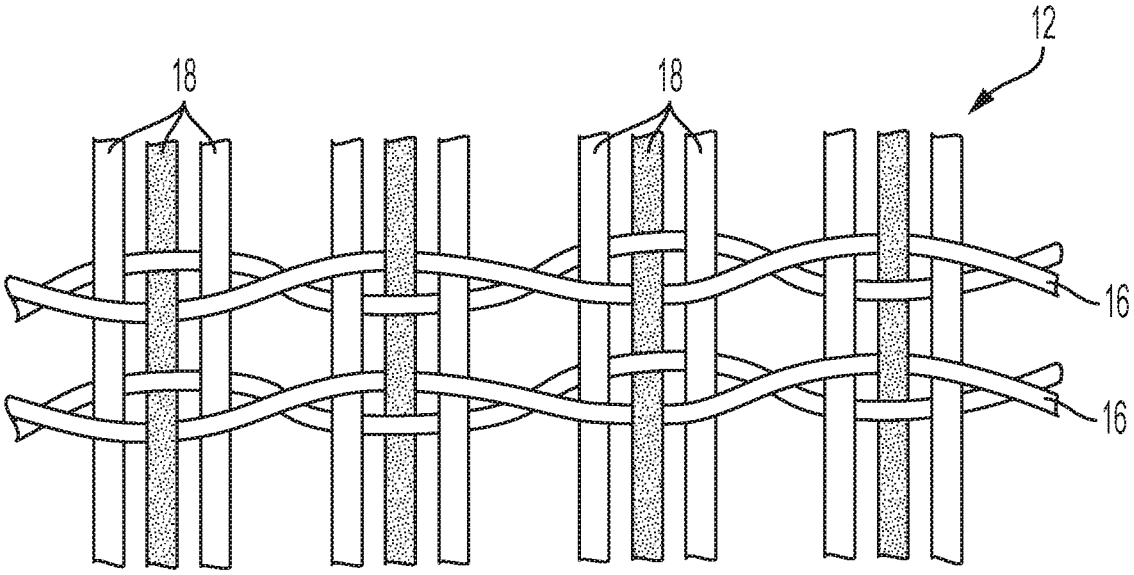
FIG. 8 is a plan view of the suspension fabric; of a prior art suspension fabric seating.

Referring to FIGS. 6 and 7, a hybrid suspended fabric seat 10 includes a fabric seating surface 12 and a plurality of compression limiters 14 attached to the seating surface 12. In an embodiment, the seating surface 12 is formed from a woven fabric 11 of monofilament fibers 16 that are oriented across the seating surface, i.e., side-to-side, and referred to as weft fibers, and fill fibers 18, that are typically textile fibers, are oriented 90 degrees relative to the monofilament fibers 16. The textile fibers 18 are oriented top-to-bottom (or up and down) along the seating surface 12 and are referred to as warp fibers. An example of a woven fabric 11 is disclosed in Coffield, U.S. Pat. No. 8,329,281, which patent is commonly assigned with the present application, the disclosure of which is incorporated herein in its entirety. Examples of the monofilament fibers 16 are disclosed in Coffield, et al., U.S. Pat. No. 8,857,033 and Coffield, U.S. Pat. No. 9,156,211, which patents are also commonly assigned with the present application, the disclosures of which are incorporated herein in their entirety.

The warp fibers or yarns 18 are relatively inelastic and elongate less than about 12 to 15 percent and preferably, less than about 5 percent. The warp fibers 18 give the fabric 11 bulk and thickness and, if desired, are able to be colored for a colored fabric suspension seating surface 12. The warp fibers 18 are used to shape the seating surface 12 by pulling the monofilament (weft) fibers 16 out of straight line position to form a parabolic shape in the overall suspension fabric seating surface. The warp fibers 18 can be formed from, for example, a polyester yarn or like, suitable textile materials.

The weft fibers 16 are typically elastic and can be formed from, for example, a block copolymer monofilament. These fibers can be orientated and elongate more than 10 percent, and up to about 30 percent when measured on a stress strain curve after an orientation process. The monofilament weft fibers 16 can be oriented and conditioned (as at an elevated temperature) and can be treated zonally to obtain a desired occupant pressure map of the seat shape 10 make the seat 10 more comfortable.

The one or more compression limiters 14 are attached to the seating surface 12. In an embodiment, a plurality of compression limiters 14 are mounted to the seating surface 12 at, for example, the bottom surface 20 of the seating surface 12 (the surface opposite the occupant surface 22), and define a hybrid fabric 24. By providing the compression limiters 14, the hybrid fabric 24 can function as a tensile/compression member similar to bending members, instead of being a 100% tension member, in that compression occurs at about the surface at which a force is applied and tension occurs at about the opposite surface. As such, the hybrid fabric 24 can change the design parameters of the suspension seat 10 by taking into consideration the compressive strength of the compression limiters 14. One such material for forming the compression limiters 14 is a foam material which can provide the traditional suspension fabric tension characteristics needed for comfort. The hybrid fabric 24 comprising the compression limiters 14 may be designed using Euler's formulas to calculate the bending strength for 3 point bends.

The compression limiters 14 can be formed from a suitable foam material, such as polyester block copolymer. In an embodiment, the compression limiters 14 may be formed from one or more thermoplastic copolyesters (TPCs), such as those available under the tradename ARNITEL® from DSM. For example, compression limiters 14 may be made from foams of ARNITEL® EM400 TPC, ARNITEL® EM460 TPC, ARNITEL® EL250 TPC, and the like.

In an embodiment, the hybrid fabric 24 may be formed by permanently attaching a plurality of foam compression limiters 14 to the fabric 11. For example, the foam compression limiters 14 may be made using a foam-shaping molding device and sealed to the fabric 11. For example, steam may be injected to melt/soften the monofilament fibers 16 of the fabric 11 and the foam compression limiters 14 to create a bond therebetween. Such bonding characteristics in the hybrid fabric 24 allow the fabric 11 and the foam compression limiters 14 (as the hybrid fabric 24) to function as a single element in the suspension fabric seating surface 12, and reduce the risk of the foam compression limiters 14 separating from the fabric 24 during use, which could result in a reduction in suspension performance and a change from the desired seating shape.

When the hybrid fabric 24 is distorted, for example when the fabric 24 conforms to an occupant in the seat 10, the compression limiters 14 conform with the fabric 24, but also limit the amount of movement or distortion of the seating surface 12.

The foam compression limiters 14 and some or all of the fabric 11 may be formed from the same material or different materials. For example, the foam compression limiters 14 and some portion or all of the fabric 11 may be formed from a TPC. In embodiments, the compression limiters 14 are oriented in the direction of the monofilament, e.g., weft, fibers and bond to the weft fibers 16.

In an embodiment, a suspension fabric seat 10 may have a frame 26, and a hybrid fabric 24 comprising a woven fabric 11 and a plurality of compression limiters 14. The hybrid fabric 24 may be attached to and suspended from the frame 26. The hybrid fabric 24 may also be used as a suspension fabric for other structures, such as a headrest, armrest, footrest, and the like, all of which structures are within the scope and spirit of the present disclosure.

In an embodiment, the compression limiters 14 are formed from a plurality of foam elements having a shape/geometry configured to manipulate the shape of the hybrid fabric 24 when suspended. The foam elements 14 may be attached to one side 20 of the fabric and function to limit the compression of the fabric 24 and to provide an asymmetric internal stress distribution across the hybrid fabric 24. The hybrid fabric 24 having such an asymmetric stress distribution may be curved or may curve naturally due to the unbalanced internal stresses of the fabric 24 as mounted to the frame 26 (see for example, FIGS. 6 and 7.) The foam compression limiters 14 can be curved using a one-sided bonded foam to form a curve in a free state. The compression limiters 14 may also enhance the curve of the hybrid fabric 24 while the hybrid fabric is under tension. As such, the compression limiters 14 may also act as a tension limiter on the fabric.

Figure 4A:
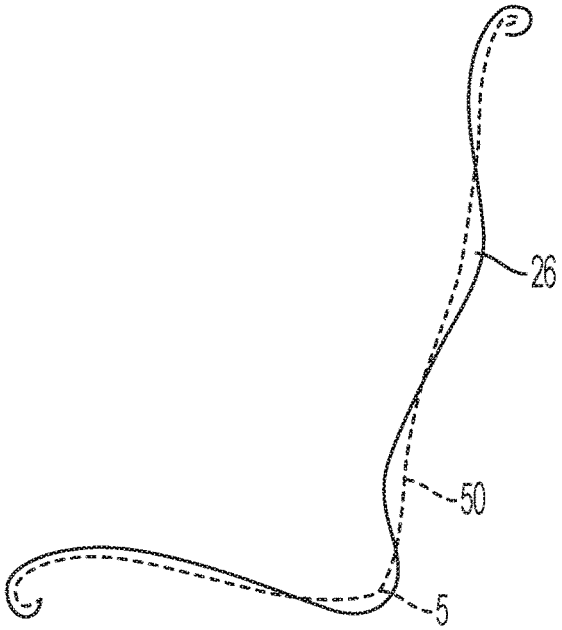
FIGS. 4A and 4B illustrate suspension frame length of line and suspension fabric center length of line of a suspension fabric chair according to an embodiment.
Figure 4B:
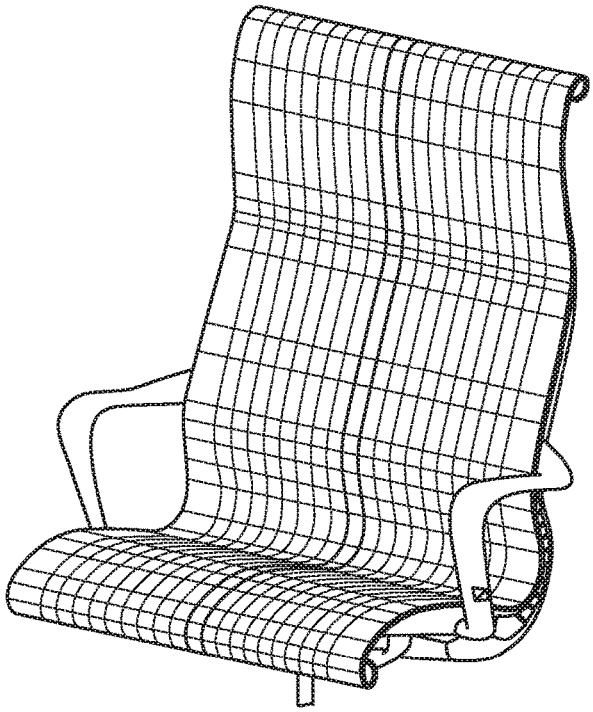
Figure 5:
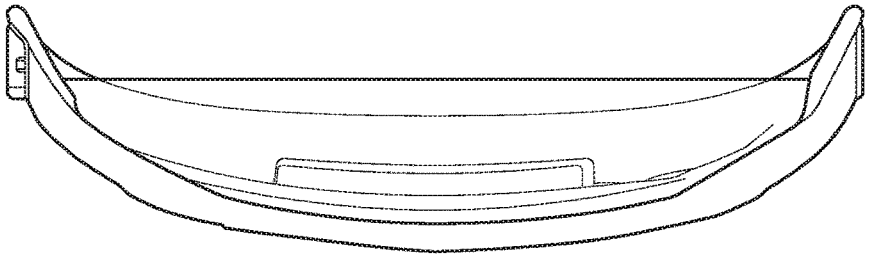
FIG. 5 PRIOR ART
FIG. 5 illustrates a prior art suspension fabric seating shape.

Dimensional shrink of the fabric 11 may be exhibited during the foam over-molding process. The block copolymer fabric fibers 16 may be annealed during steam injection of the foam molding and the annealing process may shorten the fabric length of line (see 50 in FIG. 4A) relative to the foam over molding, creating a curved foam. The amount of annealing may be controlled or limited based on the fabric pinch or anchoring at the cavity parting line (the juncture of the fabric 11 and the mold tool or anchor that defines the mold for the compression limiters 14) during the foam shape molding process.

Referring to FIGS. 10A-10D, the fabric 11, 24 can be mounted to the frame 26 in a number of ways. For example, a carrier 28 can be formed on a periphery of the fabric 11, 24 and the carrier 28 inserted into a channel 30 in the frame 26. The carrier 28 can be overmolded onto the fabric 11, 24 to form a bond between the fabric 11, 24 and the carrier 28. Overmolding can be carried out such that some of the fibers, for example, the monofilament fiber 16, soften and/or melt and fuse with the carrier 28 material during the overmolding process to create a strong bond between the fabric 11, 24 and the carrier 28. A variety of materials can be used for the carrier 28, such as a block copolymer that is compatible with the fabric 11, 24 materials. Other materials will be recognized by those skilled in the art. It will also be appreciated that overmolding the carrier 28 onto fabric 11, 24 can be carried out before the compression limiters 14 are secured to the fabric 11 or after the compression limiters 14 are secured to the (hybrid) fabric 24, and that both scenarios are contemplated by this disclosure.

Figure 9A:
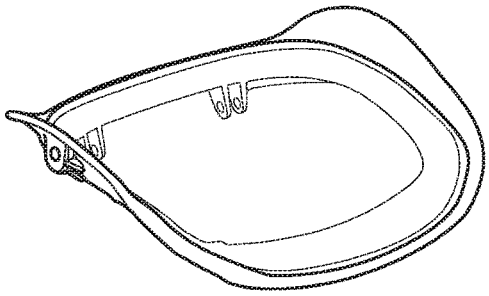
FIG. 9A PRIOR ART
FIGS. 9A and 9B are a perspective top view and a cross-sectional view of a prior art suspension fabric seat.
Figure 9B:
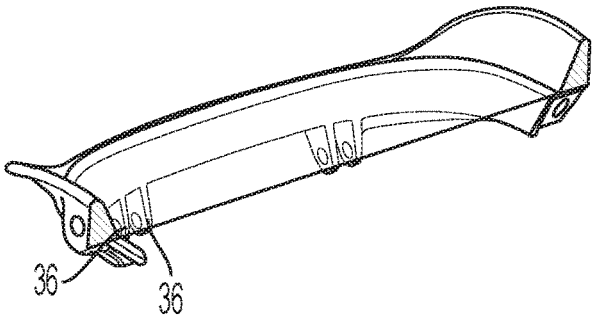
FIG. 9B PRIOR ART

In embodiments a protective barrier 34, such as a foam member can be provided between the seat occupant and the suspension frame 26 hard points 36 (see for example, FIGS. 9A and 9B) that are found on the seat bottom and back bolsters of many seats. The bolster supports 36 are designed as part of the suspension frame 26 that provides structure for, and retains the tension of, the suspended fabric seating surface 12.

Figure 10A:
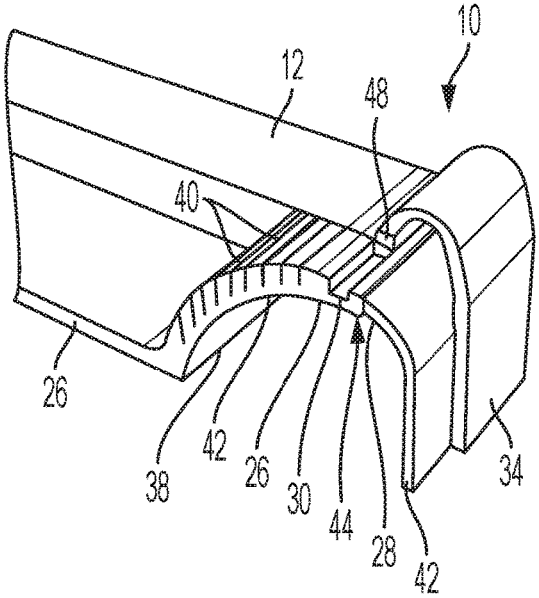
FIGS. 10A-10E illustrate cross-sectional views of a flex frame system of a suspension fabric chair according to an embodiment.
Figure 10B:
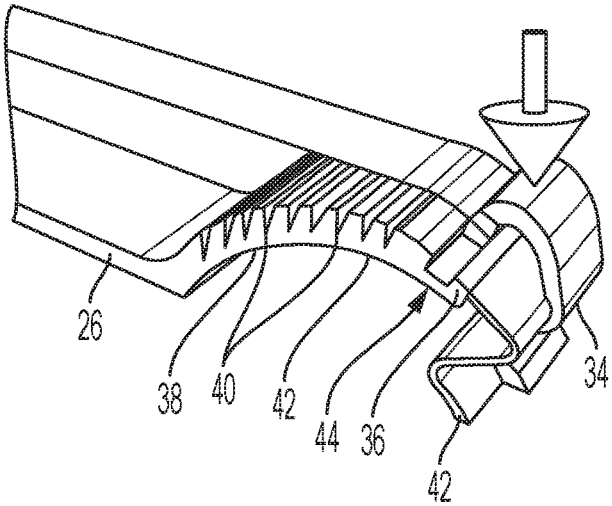
Figure 10C:
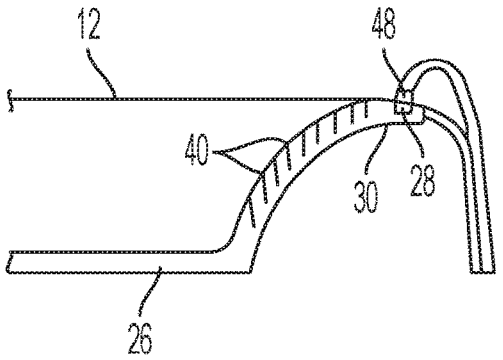
Figure 10D:
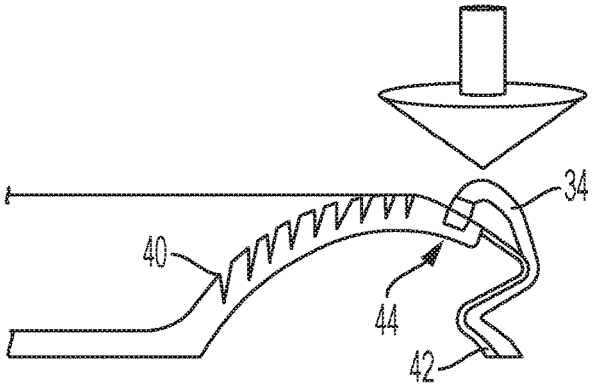
Figure 10E:
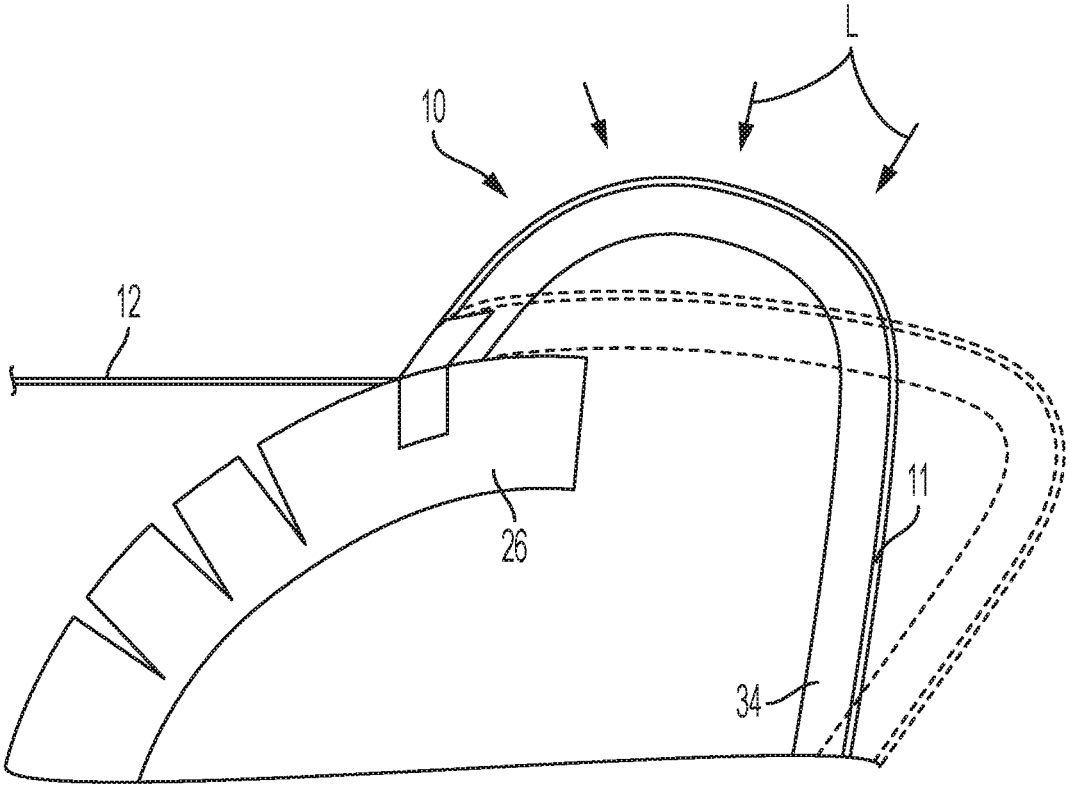

In the embodiment illustrated in FIGS. 10A-E, the frame 26 can be formed with a flexible region 38 that includes, for example, slits 40 formed in the frame 26 that are configured to flex when under load. A leg 42 can be formed at about an edge 44 of the frame 26 to accommodate, support and limit flexing of the frame 26. In an embodiment, the leg 42 is formed from a resilient material so as to bend in an accordion-like manner to support the frame edge 44 as a load is applied to the frame 26, as seen in FIG. 10D. The leg 42 can be formed from a variety of materials, such as a thermoplastic elastomer (TPE) or the like.

The protective barrier 34, such as a foam covering, can be positioned at the frame edge 44 and over the leg 42 to provide the protective barrier between the seat occupant and the frame 26. The foam 34 can be mounted to the fabric 24 and/or the carrier 28, and traverse along the leg 42 to further provide a barrier between the occupant and the frame 26/leg 42. The foam 34 can be mounted to the fabric 24 and/or the carrier 28 by a foam carrier 48, and can be bonded to the fabric 24 or the carrier 28 as a secondary piece or in a secondary process. As illustrated in FIGS. 10A-10E, the foam 34 follows the leg 42 and bends with the leg 42 (also in an accordion-like manner) as a load is applied to the frame 26. As best seen n FIG. 10E, as the frame 26 flexes, the foam 34 rests on the frame 26 edge to provide a barrier for the seat occupant.

The foam 34 can have a reaction force of about 0.25 to 80 Newtons for a softness feel to the occupant. The suspension fabric 11 can be applied to or extended over the foam 34, or the foam 34 can be designed to match the suspension fabric 11 in appearance and style to ensure complete aesthetic synergy of the seat 10.

A method of making the suspended fabric seat includes positioning a woven fabric 11 in a frame 26 and securing a plurality of compression limiters 14 to the woven fabric 11 to form a hybrid fabric 24. The fabric 11, 24 is formed from monofilament fibers 16 that are oriented in a first direction and textile fibers 18 oriented in a second direction transverse to the first direction.

The compression limiters 14 can be bonded to the fabric 11 prior to positioning the hybrid fabric 24 in the frame 26, or the compression limiters 14 can be bonded to the fabric 11 after positioning the fabric 11 in the frame 26. The fabric 11, 24 can be secured in a carrier 28 and the carrier 28 secured to the frame 26.

In a method, the carrier 28 is overmolded onto the fabric 11, 24. The compression limiters 14 can be oriented in the first direction.

In the present disclosure, the words "a" or "an" are to be taken to include both the singular and the plural. Conversely, any reference to plural items shall, where appropriate, include the singular. It will be appreciated by those skilled in the art that the relative directional terms such as upper, lower, rearward, forward and the like are for explanatory purposes only and are not intended to limit the scope of the disclosure.

All patents or patent applications referred to herein, are hereby incorporated herein by reference, whether or not specifically done so within the text of this disclosure.

From the foregoing it will be observed that numerous modification and variations can be effectuated without departing from the true spirit and scope of the novel concepts of the present film. It is to be understood that no limitation with respect to the specific embodiments illustrated is intended or should be inferred. The disclosure is intended to cover by the appended claims all such modifications as fall within the scope of the claims.

The invention claimed is:

1. A seat, comprising:

a frame;

a woven fabric suspended in the frame, the woven fabric formed from monofilament fibers that are oriented in a first direction and textile fibers oriented in a second direction transverse to the first direction; and a plurality of compression limiters attached to the woven fabric, wherein the plurality of compression limiters are formed from a foam material.

2. The seat of claim 1, wherein the plurality of compression limiters are formed from a material compatible with one or both of the monofilament and textile fibers.

3. The seat of claim 2, wherein the plurality of compression limiters are oriented in the first direction.

4. The seat of claim 3, wherein the plurality of compression limiters are mounted on a surface of the woven fabric opposite to an occupant side of the woven fabric.

5. The seat of claim 1, wherein the plurality of compression limiters are bonded to the woven fabric to conform with the woven fabric when the woven fabric is distorted.

6. The seat of claim 1, wherein the woven fabric forms a seat bottom.

7. The seat of claim 1 further including a carrier positioned on a periphery of the woven fabric, and wherein the carrier is secured in the frame.

8. The seat of claim 7, wherein the carrier is overmolded onto the woven fabric.

9. The seat of claim 1, wherein the frame includes a flexible region configured to permit the frame to flex when under load.

10. The seat of claim 9, wherein the flexible region includes a series of slits in the frame.

11. The seat of claim 9 further including a flexible leg member extending from an edge of the frame opposite the woven fabric.

12. The seat of claim 11 further including a resilient member extending from the woven fabric along the flexible leg member.

13. The seat of claim 12, wherein the resilient member is a foam member.

14. The seat of claim 13, wherein the woven fabric extends over the foam member.

15. The seat of claim 1, wherein the compression limiters, when subject to an occupant load, are in compression along a surface at which the compression limiters are mounted to the woven fabric.

16. A method of making a seat, comprising:

positioning a woven fabric in a frame, the woven fabric formed from monofilament fibers that are oriented in a first direction and textile fibers oriented in a second direction transverse to the first direction; and securing a plurality of compression limiters to the woven fabric by melting the monofilament fibers and the plurality of compression limiters to create a bond therebetween.

17. The method of claim 16, wherein the plurality of compression limiters are bonded to the woven fabric.

18. The method of claim 16, wherein the plurality of compression limiters are oriented in the first direction.

19. The method of claim 16 further including overmolding a carrier onto the woven fabric and securing the carrier to the frame.

20. A seat, comprising:

a frame;

a woven fabric suspended in the frame, the woven fabric formed from monofilament fibers that are oriented in a first direction and textile fibers oriented in a second direction transverse to the first direction; and a plurality of compression limiters attached to the woven fabric, wherein the plurality of compression limiters are mounted on a surface of the woven fabric opposite to an occupant side of the woven fabric.

* * * * *